US008956202B2

(12) United States Patent
Tassetti et al.

(10) Patent No.: US 8,956,202 B2
(45) Date of Patent: Feb. 17, 2015

(54) SYSTEM FOR MACHINING A BEVEL

(75) Inventors: Jean-Paul Tassetti, Orchamps-Vennes (FR); Christophe Vuillemin, Le Belieu (FR); Fabien Bez, Montlebon (FR)

(73) Assignee: Comadur S.A., Le Locle (CH)

( * ) Notice: Subject to any disclaimer, the term of this patent is extended or adjusted under 35 U.S.C. 154(b) by 230 days.

(21) Appl. No.: 13/529,348

(22) Filed: Jun. 21, 2012

(65) Prior Publication Data

US 2012/0329372 A1 Dec. 27, 2012

(30) Foreign Application Priority Data

Jun. 24, 2011 (EP) ..... 11171314

(51) Int. Cl.

| | |
|---|---|
| ***B24B 9/00*** | (2006.01) |
| ***B24B 9/08*** | (2006.01) |
| ***B24B 21/00*** | (2006.01) |
| ***G04D 3/06*** | (2006.01) |

(52) U.S. Cl.

CPC ..... *B24B 9/085* (2013.01); *B24B 21/002* (2013.01); *G04D 3/065* (2013.01)

USPC ..... 451/177; 451/43; 451/168; 451/306; 451/387; 451/389

(58) Field of Classification Search

CPC ..... B24B 9/085; B24B 9/065; B24B 21/04; B24B 21/002; B24B 21/12; B24B 21/14; B24B 21/004; B24B 7/24; B24B 7/242; B24B 13/005; B24B 13/0057; B24B 13/0052; B24B 13/0055; B24B 37/30; B24B 9/146; B24B 21/006

USPC ..... 451/43, 168, 177, 306, 387, 389, 380, 451/390, 303, 305, 299

See application file for complete search history.

(56) References Cited

U.S. PATENT DOCUMENTS

| | | | | | |
|---|---|---|---|---|---|
| 753,992 | A | * | 3/1904 | Maroher | 451/389 |
| 828,853 | A | * | 8/1906 | Ives | 451/321 |
| 1,368,263 | A | * | 2/1921 | Johnston | 451/281 |
| 1,998,642 | A | * | 4/1935 | Smith | 451/239 |
| 2,534,384 | A | * | 12/1950 | Spira | 451/273 |
| 3,183,629 | A | * | 5/1965 | Ver Meulen | 451/296 |
| 3,439,456 | A | * | 4/1969 | Bailey | 451/278 |

(Continued)

FOREIGN PATENT DOCUMENTS

| | | |
|---|---|---|
| JP | 53-133290 U | 10/1978 |
| JP | 56-7820 (B2) | 2/1981 |

(Continued)

OTHER PUBLICATIONS

European Search Report issued Dec. 5, 2011 in corresponding European Application No. 11 17 1314 filed on Jun. 24, 2011 (with an English Translation).

*Primary Examiner* — George Nguyen

(74) *Attorney, Agent, or Firm* — Oblon, Spivak, McClelland, Maier & Neustadt, L.L.P.

(57) ABSTRACT

A system for machining a bevel on a disk shaped part including a grinding device having an abrasive, a device for securing the part including a support to which the part is fitted and which is integral with an axis of rotation. The securing device further includes a system for orienting the axis of rotation to define the angle of the bevel and a system for moving the support closer to the abrasive in order to machining the part under stress. The invention concerns the field of crystals for timepieces.

8 Claims, 4 Drawing Sheets

(56) References Cited

U.S. PATENT DOCUMENTS

| | | | | |
|---|---|---|---|---|
| 3,488,174 | A * | 1/1970 | Boudet | 65/61 |
| 3,668,809 | A * | 6/1972 | Coon | 451/296 |
| 3,668,814 | A * | 6/1972 | Freerks et al. | 451/59 |
| RE30,357 | E * | 8/1980 | Henry | 451/389 |
| 4,571,893 | A * | 2/1986 | Braasch | 451/529 |
| 5,445,554 | A * | 8/1995 | Hosokawa | 451/11 |
| 5,664,985 | A * | 9/1997 | Williams et al. | 451/5 |
| 5,700,184 | A * | 12/1997 | Domenella | 451/194 |
| 6,203,409 | B1 * | 3/2001 | Kennedy et al. | 451/43 |
| 6,402,596 | B1 * | 6/2002 | Hakomori et al. | 451/44 |
| 6,589,102 | B2 * | 7/2003 | Wess et al. | 451/42 |
| 7,309,278 | B2 * | 12/2007 | Shibata | 451/384 |
| 7,367,873 | B2 * | 5/2008 | Ishii et al. | 451/168 |
| 7,682,225 | B2 * | 3/2010 | Hongo et al. | 451/303 |
| 7,862,402 | B2 * | 1/2011 | Hongo et al. | 451/5 |
| 8,187,055 | B2 * | 5/2012 | Takahashi et al. | 451/9 |
| 8,210,905 | B2 * | 7/2012 | Sakairi | 451/44 |
| 2010/0255757 | A1 * | 10/2010 | Shigeta et al. | 451/8 |

FOREIGN PATENT DOCUMENTS

| | | |
|---|---|---|
| JP | 05-329760 | 12/1993 |
| WO | WO 02/49802 A1 | 6/2002 |

* cited by examiner

SYSTEM FOR MACHINING A BEVEL

This application claims priority from European Patent Application No. 11171314.5 filed Jun. 24, 2011, the entire disclosure of which is incorporated herein by reference.

FIELD OF THE INVENTION

The invention relates to a lapidary system for a part made of hard material such as corundum and, more specifically, a system of this kind for forming a bevel.

BACKGROUND OF THE INVENTION

Watch crystal bevels are generally formed by a grinding wheel which moves tangentially at the bevel angle against the edge of the part to be cut. This technique is widely used but is slow to perform, regularly causes chips (slivers of material) and requires subsequent brushing.

SUMMARY OF THE INVENTION

It is an object of the present invention to overcome all or part of the aforementioned drawbacks, by proposing a system for machining a bevel which speeds up manufacture and which reduces the discard rate.

The invention therefore relates to a system for machining a bevel on a disk shaped part including a grinding device comprising abrasive means, a device for securing the part comprising a support onto which said part is fitted and which is integral with an axis of rotation, characterized in that the securing device further includes a means of orienting the axis of rotation to define the angle of said bevel and a means of moving the support closer to the abrasive means in order to machine the part under stress.

Thus, advantageously, the bevel angle of the part is directly given by the inclination of the part relative to the abrasive means, and the stress caused by the support moving means enables beveling to be performed more quickly and prevents the material from undergoing excessive stress, while rendering any subsequent step of brushing the bevel unnecessary.

In accordance with other advantageous features of the invention:

- the abrasive means is moveable so as to improve machining;
- the abrasive means is formed by a rotatably mounted abrasive strip;
- underneath the area of contact between the abrasive strip and the part, the grinding device includes a resilient means for maintaining the contact between the abrasive strip and the part;
- the elastic means is formed by an elastomer block;
- the means of moving the support closer includes a vertical slide for moving the support vertically relative to the abrasive means;
- the orientating means includes a worm-toothed wheel assembly for shifting the inclination of the axis of rotation of the support relative to the means of moving the support closer;
- the securing device includes a horizontal slide for moving the support transversely relative to the abrasive means;
- the horizontal slide is moved via a connecting rod-crank assembly in order to move the support relative to the abrasive means in a to-and-fro motion;
- the disk shaped part is a spherical crystal.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1:
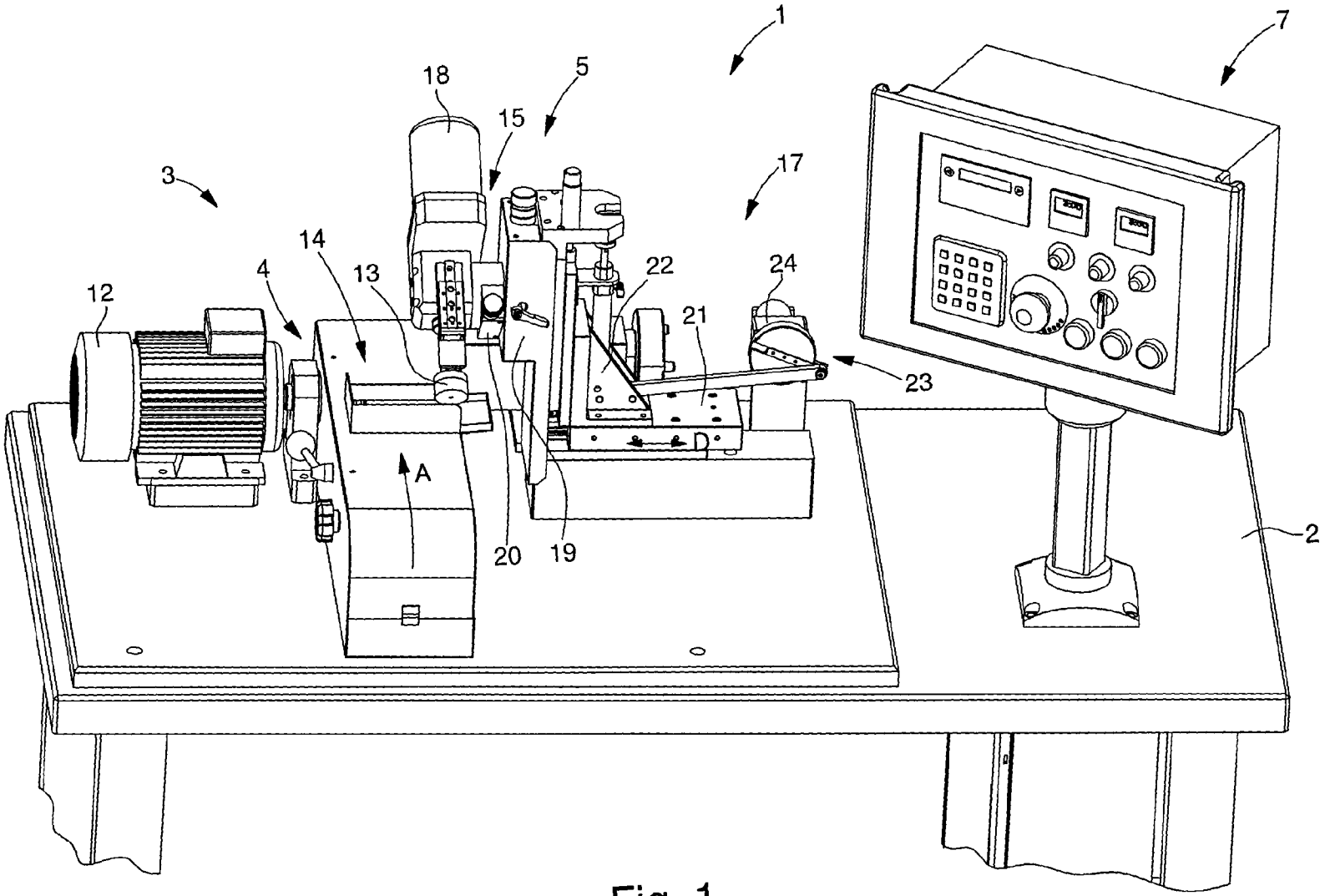
FIG. 1 is a perspective elevation of a system according to the invention.

As illustrated in FIG. 1, the invention relates to a system 1 for machining a bevel 32, 34 for a disk shaped part 31 made of hard material such as corundum. According to the invention, part 31 may be intended to form a spherical timepiece crystal.

Machining system 1 includes a grinding device 3, a device 5 for securing the part and a control device 7 for controlling the actuators of system 1. All of the devices are mounted on a frame 2.

Figure 2:
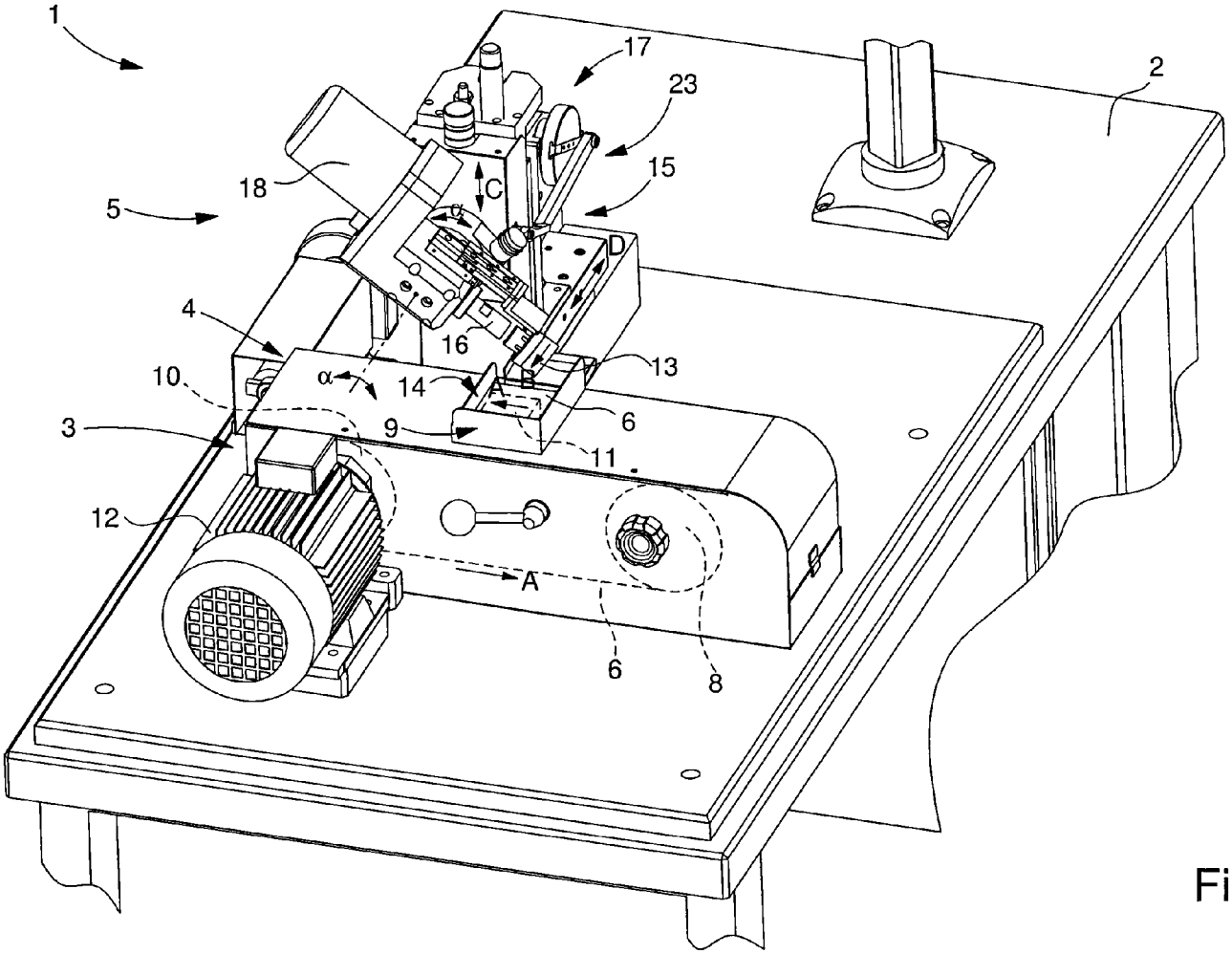
FIG. 2 is a perspective side view of a system according to the invention.
Figure 3:
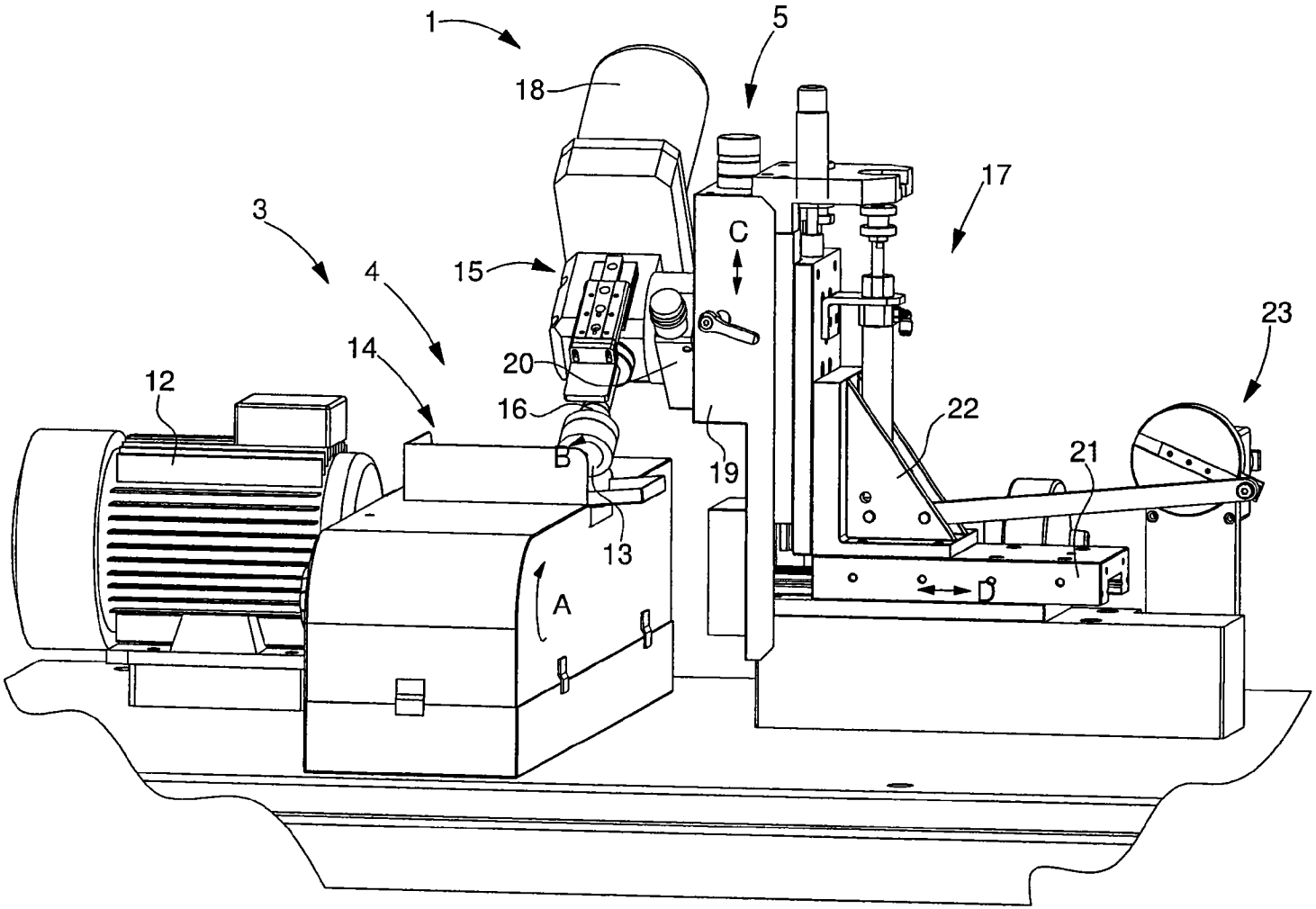
FIG. 3 is an enlarged view of one part of FIG. 1.

According to the invention, grinding device 3 includes an abrasive means 4 which is preferably moveable so as to improve machining. As visible in FIG. 2, abrasive means 4 is formed by an abrasive strip 6 rotatably mounted on two rollers 8, 10 and driven by an actuator 12 in motion A. As visible in FIGS. 1 to 3, grinding device 3 includes a restricted area 14 in which abrasive means 4 is accessible and protected by vertical walls to limit blasting of material and to safeguard operations.

Advantageously according to the invention, underneath the area 14 of contact between abrasive strip 6 and part 31 to be machined, grinding device 3 further includes a resilient means 9 for maintaining the contact between abrasive strip 6 and said part. Thus, preferably, resilient means 9 is formed by a block 11 made of elastomer, such as rubber, several centimeters thick and covering all or part of restricted area 14 underneath abrasive means 4.

According to the invention, securing device 5 of part 31 includes a support 13 to which part 31 to be machined is fitted and which is integral with an axis of rotation 16 driven by an actuator 18 in motion B. Advantageously according to the invention, securing device 5 further includes a means 15 of orienting the axis of rotation 16 to define the angle $\beta$, $\gamma$ of bevel 32, 34 and a means 17 for moving support 13 closer to abrasive means 4 in order to machine part 31 under stress.

Preferably according to the invention, means 17 for moving the support closer includes a vertical slide 19 for moving support 13 vertically in direction C relative to abrasive means 4. Indeed, it was found that the combination of the stress caused by means 17 and the compensation performed by resilient means 9 to maintain the contact between abrasive strip 6 and the part 31 for machining enabled bevels 32, 34 to be formed without the material undergoing excessive stresses, resulting in a low discard rate and the omission of an additional step of brushing bevel 32, 34.

According to the invention orienting means 15 preferably includes a worm-toothed wheel assembly 20 for shifting the inclination $\alpha$ of axis of rotation 16 of support 13 relative to means 17 for moving support 13 closer. Thus, advantageously, the bevel angle $\beta$, $\gamma$ of part 31 is directly given by the inclination $\alpha$ of part 31 relative to abrasive means 4.

Finally, securing device 5 preferably includes a horizontal slide 21 for moving support 13 transversely in direction D relative to abrasive means 4. As visible in FIGS. 1 to 3, horizontal slide 21 is used as a base for securing device 5 onto frame 2. Thus, via a set square shaped member 22, horizontal slide 21 carries vertical slide 19, which in turn carries orienting means 15 and the support 13—axis of rotation 16—actuator 18 assembly.

Advantageously according to the invention, horizontal slide 21 is moved via a connecting rod-crank assembly 23 in order to move support 13 transversely in direction D relative to abrasive means 4 in a to-and-for motion. As visible in FIGS. 1 to 3, the connecting rod-crank assembly 23 is connected to horizontal slide 21 on set square shaped member 22.

Figure 4:
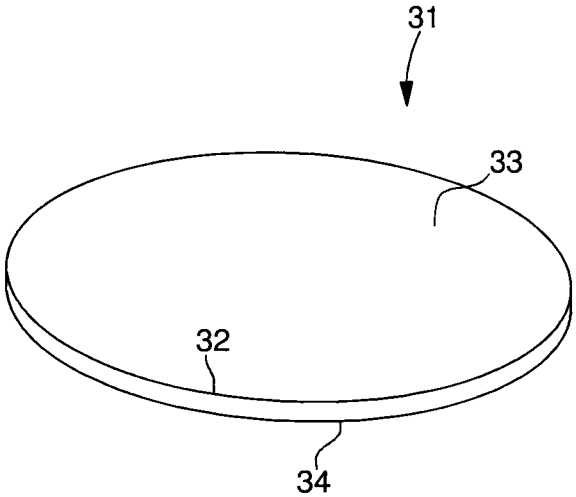
FIG. 4 is a perspective view of a part obtained by the system according to the invention.
Figure 5:
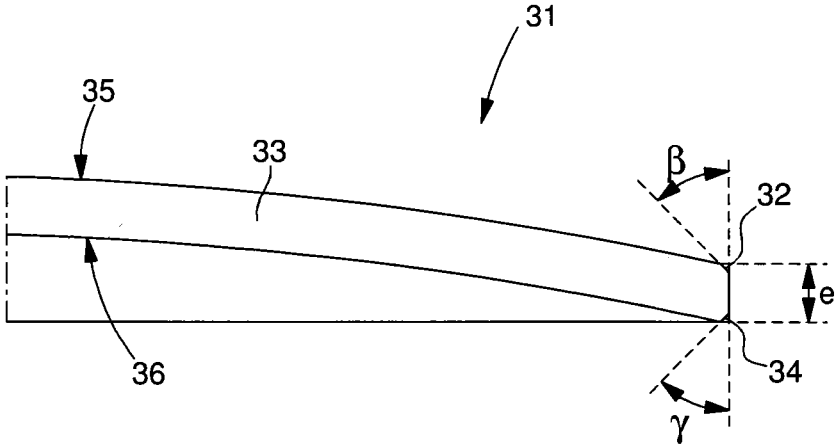
FIG. 5 is a partial cross-section of the part illustrated in FIG. 4.

An example part 31 modified by machining system 1 is illustrated in FIGS. 4 and 5. Part 31 includes a substantially disk shaped body 33 whose edges have bevels 32, 34 at predefined angles β, γ. As visible in FIG. 5, part 31 is a spherical crystal, i.e. the difference in dimension between the external radius 35 and an internal radius 36 thereof is the constant thickness e.

Of course, this invention is not limited to the illustrated example but is capable of various variants and alterations that will appear to those skilled in the art. In particular, the shape of part 31 may be different and/or made of a different material from corundum and/or for an application other than a timepiece.

What is claimed is:

1. A system for machining a bevel on a watch crystal, said system comprising:

a grinding device configured to form said bevel at an angle on said watch crystal, said grinding device comprising an abrasive strip, a securing device for securing the watch crystal, said securing device including a support configured to support said watch crystal and defining an axis of rotation, the securing device further including a mechanism for orienting the axis of rotation and configured to define the angle of the bevel to be formed by said grinding device, wherein the securing device includes a horizontal slide for moving the support transversely relative to the abrasive strip, and a mechanism for moving the support closer to the abrasive strip, so as to machine the watch crystal under stress, wherein the abrasive strip is movable and rotably mounted in order to improve machining, and wherein, underneath the area of contact between the abrasive strip and the watch crystal, the grinding device includes a resilient device for maintaining the contact between the abrasive strip and the watch crystal.

2. The system according to claim 1, wherein the resilient device comprises an elastomer block.

3. A system for machining a bevel on a disk shaped part, said system comprising:

a grinding device configured to form said bevel at an angle on said part, said grinding device comprising an abrasive, a securing device for securing the part, said securing device including a support configured to support said part and defining an axis of rotation, the securing device further including a mechanism for orienting the axis of rotation and configured to define the angle of the bevel wherein the securing device includes a horizontal slide for moving the support transversely relative to the abrasive, and a mechanism for moving the support closer to the abrasive, so as to machine the part under stress, wherein, underneath the area of contact between the abrasive and the part, the grinding device includes a resilient device for maintaining the contact between the abrasive and the part, wherein the mechanism for moving the support closer includes a vertical slide for moving the support vertically relative to the abrasive.

4. A system for machining a bevel on a disk shaped part, said system comprising:

a grinding device configured to form said bevel at an angle on said part, said grinding device comprising an abrasive, a securing device for securing the part, said securing device including a support configured to support said part and defining an axis of rotation, the securing device further including a mechanism for orienting the axis of rotation and configured to define the angle of the bevel wherein the securing device includes a horizontal slide for moving the support transversely relative to the abrasive, and a mechanism for moving the support closer to the abrasive, so as to machine the part under stress, wherein, underneath the area of contact between the abrasive and the part, the grinding device includes a resilient device for maintaining the contact between the abrasive and the part, wherein the mechanism for orienting includes an assembly for shifting the inclination of the axis of rotation of the support relative to the mechanism for moving said support closer.

5. A system for machining a bevel on a disk shaped part, said system comprising:

a grinding device configured to form said bevel at an angle on said part, said grinding device comprising an abrasive, a securing device for securing the part, said securing device including a support configured to support said part and defining an axis of rotation, the securing device further including a mechanism for orienting the axis of rotation and configured to define the angle of the bevel, and a mechanism for moving the support closer to the abrasive, so as to machine the part under stress, wherein, underneath the area of contact between the abrasive and the part, the grinding device includes a resilient device for maintaining the contact between the abrasive and the part, wherein the securing device includes a horizontal slide movable via a connecting rod-crank assembly in order to move the support in a to-and-for motion relative to the abrasive.

6. The system according to claim 1, wherein the watch crystal is a spherical crystal.

7. The system according to claim 1, wherein the grinding device includes a restricted area in which an abrasive is accessible and protected by vertical walls to limit blasting of material and to safeguard operations.

8. The system according to claim 7, wherein the resilient device covers all or part of the restricted area underneath the abrasive.

* * * * *